US009926732B2

(12) United States Patent
Bacchetti

(10) Patent No.: US 9,926,732 B2
(45) Date of Patent: Mar. 27, 2018

(54) HINGE DEVICE FOR DOORS, SHUTTERS OR THE LIKE

(71) Applicant: IN & TEC S.R.L., Bescia (IT)

(72) Inventor: Luciano Bacchetti, Nave (IT)

(73) Assignee: IN & TEC S.R.L., Brescia (IT)

( * ) Notice: Subject to any disclaimer, the term of this patent is extended or adjusted under 35 U.S.C. 154(b) by 0 days.

(21) Appl. No.: 15/515,721

(22) PCT Filed: Oct. 6, 2015

(86) PCT No.: PCT/IB2015/057625
§ 371 (c)(1),
(2) Date: Mar. 30, 2017

(87) PCT Pub. No.: WO2016/055929
PCT Pub. Date: Apr. 14, 2016

(65) Prior Publication Data

US 2017/0241180 A1 Aug. 24, 2017

(30) Foreign Application Priority Data

Oct. 6, 2014 (IT) ..... VI2014A0256
Oct. 6, 2014 (IT) ..... VI2014A0257

(51) Int. Cl.

| | |
|---|---|
| ***E05F 3/20*** | (2006.01) |
| ***E05F 3/04*** | (2006.01) |
| ***E05D 3/02*** | (2006.01) |
| ***E05F 3/12*** | (2006.01) |
| *E05F 3/10* | (2006.01) |
| *E05F 1/12* | (2006.01) |

(52) U.S. Cl.
CPC ..... *E05F 3/04* (2013.01); *E05D 3/02* (2013.01); *E05F 3/12* (2013.01); *E05F 3/20* (2013.01);

(Continued)

(58) Field of Classification Search
CPC . Y10T 16/283; Y10T 16/304; Y10T 16/2771; Y10T 16/5387; Y10T 16/537;

(Continued)

(56) References Cited

U.S. PATENT DOCUMENTS 2,118,950 A * 5/1938 Stannard ..... E05F 3/20 16/256
2,127,327 A * 8/1938 De Millar ..... E05F 3/08 16/54

(Continued)

FOREIGN PATENT DOCUMENTS

| | | |
|---|---|---|
| EP | 2682553 | 1/2014 |
| GB | 396673 | 8/1933 |

(Continued)

*Primary Examiner* — Chuck Mah
(74) *Attorney, Agent, or Firm* — Themis Law

(57) ABSTRACT

A hinge device includes a fixed element, a movable element and a slider housed in a working chamber and coupled to a pivot, so that a rotation of the movable element corresponds to the sliding of the slider. The working chamber includes an end cap and a working fluid and is divided into first and second variable volume compartment by a plunger member of the slider. A hydraulic circuit includes a first duct passing through an end cap that is in fluid communication with the first and second compartments and has an elongated tubular wall extending within the working chamber, and the interspace between the working chamber and the elongated tubular wall. The plunger member is tightly inserted in the elongated tubular wall, which includes a first peripheral conduit having a first and a second port in fluid communication with the first and respectively second compartment through the first duct.

13 Claims, 9 Drawing Sheets

(52) U.S. Cl.
CPC ..... *E05F 1/1223* (2013.01); *E05F 3/10* (2013.01); *E05Y 2201/212* (2013.01); *E05Y 2201/264* (2013.01); *E05Y 2900/132* (2013.01); *E05Y 2900/146* (2013.01); *E05Y 2900/40* (2013.01)

(58) Field of Classification Search
CPC ..... Y10T 16/5373; Y10T 16/5388; Y10T 16/2766; E05F 1/066; E05F 1/1008; E05F 1/12; E05F 1/1207; E05F 1/1223; E05F 3/00; E05F 3/04; E05F 3/10; E05F 3/12; E05F 3/20; E05F 5/00; E05D 3/02; E05D 11/02; E05D 11/04; E05D 11/084; E05D 11/1014; E05D 7/12; E05D 2005/108; E05Y 2800/00; E05Y 2201/21; E05Y 2201/264; E05Y 2201/628; E05Y 2201/638; E05Y 2201/256; E05Y 2900/132
See application file for complete search history.

(56) References Cited

U.S. PATENT DOCUMENTS 2,164,358 A * 7/1939 Stannard ..... E05F 3/20 16/54
2,456,537 A * 12/1948 Seaman ..... E05F 3/10 16/54
4,103,392 A * 8/1978 MacDonald ..... E05F 3/20 16/54
4,155,144 A * 5/1979 Koganei ..... E05F 3/20 16/54
4,485,522 A * 12/1984 Chen ..... E05F 3/20 16/303
5,152,029 A * 10/1992 Pai ..... E05D 5/10 16/54
6,205,619 B1 * 3/2001 Jang ..... E05D 5/10 16/352
7,966,693 B2 * 6/2011 Choi ..... E05F 3/20 16/284
8,752,244 B2 * 6/2014 Talpe ..... E05F 3/14 16/54
2004/0068833 A1 4/2004 Sawa
2004/0250377 A1 * 12/2004 Park ..... E05F 3/20 16/50
2010/0319260 A1 * 12/2010 Sawa ..... E05F 1/1223 49/326

FOREIGN PATENT DOCUMENTS

WO 2006036044 4/2006
WO 2007013776 2/2007

* cited by examiner

11
X
I c
18
13
51
50
112
80
82
81
70'
70"
61
73
52
83
110
16
22
60
12
20
41
60
23
62
41
31
30
33
24
170
27
103
I c
I b
11
15
D
I b
14
10
S

14

10
1
X
18
11
13
51
50
112
80
82
52
70'
81
73
110
16
83
12
20
60
41
23
31
62
41
30
33
34
24
141
142
140
27
143

HINGE DEVICE FOR DOORS, SHUTTERS OR THE LIKE

FIELD OF INVENTION

The present invention is generally applicable to the technical field of closing and/or checking hinges for doors, shutters or similar closing elements, and it particularly relates to a hinge device for rotatably moving and/or checking during the opening and/or closing a closing element, such as a door, a shutter or the like, anchored to a stationary support structure, such as a wall or a frame.

BACKGROUND OF THE INVENTION

As known, hinges generally comprise a movable element, usually anchored to a door, a shutter or the like, hinged on a fixed element, usually anchored to the support frame thereof, or to a wall and/or a floor.

From documents U.S. Pat. No. 7,305,797, US2004/206007 and EP1997994 hinges are known wherein the action of the closing means that ensure the return of the shutter in the closed position is undisputed. From document EP0407150 a door closing is known that includes hydraulic damping means to counteract the action of the closing means.

Such known devices are more or less high-bulkiness and, consequently, they have an unpleasant visual impact. Moreover, they do not allow the adjustment of the closing speed and/or the snap-fit closing of the door, or, nevertheless, they do not allow a simple and fast adjustment.

Furthermore, such known devices have a large number of constructing parts, being both difficult to manufacture and relatively expensive, besides requiring frequent maintenance.

Other hinges are known from documents GB19477, U.S. Pat. No. 1,423,784, GB401858, WO03/067011, US2009/241289, EP0255781, WO2008/50989, EP2241708, CN101705775, GB1516622, US20110041285, WO200713776, WO200636044, WO2006025663 and US20040250377.

Furthermore, from documents GB396673, WO2011/41880 and EP0215264 hydraulic hinges are known wherein the hydraulic circuit is at least partially contained in the end cap of the hinge thereof.

Such known hinges may be ameliorated in terms of bulkiness and/or reliability and/or performance.

SUMMARY OF THE INVENTION

Object of the present invention is to at least partially overcome the above mentioned drawbacks, by providing a hinge device of high functionality, constructing simplicity and low cost.

Another object of the invention is to provide a hydraulic hinge device extremely easy to manufacture.

Another object of the invention is to provide an extremely safe hinge device.

Another object of the invention is to provide a low-bulkiness hinge device.

Another object of the invention is to provide a hinge device that ensures the checked movement of the door to which it is coupled, upon the opening phase and/or the closing phase.

Another object of the invention is to provide a hinge device that has a minimum number of constituent parts.

Another object of the invention is to provide a hinge device extremely easy to install.

Another object of the invention is to provide a hinge device that may be assembled on the closing elements having opening both towards the right and the left.

Such objects, as well as other that will appear more clearly hereinafter, are fulfilled by a hinge device having one or more of the features herein described and/or claimed and/or shown.

The hinge device is particularly useful for rotatably moving and/or checking during the opening and/or closing a closing element, such as a door, a shutter or the like. The closing element may be anchored to a stationary support structure, such as a wall or a frame.

The device includes a fixed element anchorable to the stationary support structure and a movable element anchorable to the closing element.

The movable element and the fixed element are reciprocally coupled to rotate around a longitudinal axis between an open position and a closed position.

Furthermore, the device includes at least one slider movable along another axis between a first end-stroke position, corresponding to one of the open and closed positions of the movable element, and a second end-stroke position, corresponding to the other of the open and closed positions of the movable element. The sliding axis of the at least one slider may be parallel to, perpendicular to, or coincident with the axis of rotation of the movable element with respect to the fixed one.

Suitably, one of the fixed element and the movable element comprises at least one working chamber defining the sliding axis of the at least one slider, while the other of the fixed element and the movable element comprises a pivot defining the above mentioned axis of rotation. The at least one working chamber is closed through at least one end cap.

The pivot and the at least one slider are reciprocally coupled so as the rotation of the movable element corresponds to the at least partial sliding of the at least one slider and vice versa.

The working chamber includes a working fluid acting upon the at least one slider to hydraulically counteract the action thereof.

The at least one slider includes a plunger member susceptible to divide the at least one working chamber in at least one first and one second variable volume compartment fluidly communicating therebetween and preferably adjacent.

The plunger member comprises a passing-through opening to put in fluid communication the first and the second variable volume compartment and the valve means interacting therewith to allow the passage of the working fluid between the first compartment and the second compartment during one of the opening or closing of the closing element and to prevent the passage thereof during the other of the opening or closing thereof.

Furthermore, a hydraulic circuit is provided to allow the passage of the working fluid between the first compartment and the second compartment during the other of the opening or closing of the closing element.

Suitably, the hydraulic circuit may include at least one first channel with a first opening in one of the first compartment and the second compartment and at least one first duct passing through the at least one end cap, the at least one first duct may include at least one first opening fluidly communicating with the first outlet of the at least one first channel and at least one first outlet fluidly communicating with the other of the first compartment and the second compartment.

Advantageously, the hydraulic circuit may further include at least one second duct passing through the at least one end cap to put in fluid communication the first compartment and the second compartment.

In a preferred but not exclusive embodiment, the at least one end cap may further include valve means acting upon the at least one second duct to selectively open upon the passage of the working fluid through the at least one channel when the pressure in the at least one working chamber exceeds a predetermined threshold value.

In this way, the hinge device is extremely safe. In fact, in case of overpressures, the valve means open thus preventing the breakage or unhinging of the closing element.

To do the object, the above mentioned threshold value may be calibrated so as to avoid the unhinging of the closing element by a user that forces the opening and/or closing thereof.

Preferably, the valve means may be closed when the pressure in the at least one working chamber is below the predetermined threshold value, so as to force the passage of the working fluid through the at least one first duct.

Irrespective of the presence or absence of the overpressure valve means described above, the at least one end cap may include an elongated tubular wall extending within the working chamber.

Suitably, the hydraulic circuit may include the interspace between the working chamber and the elongated tubular wall.

Advantageously, the elongated tubular wall may include at least one first peripheral conduit having a first port in one of the first compartment and the second compartment and a second port in fluid communication with other of the first compartment and the second compartment through the at least one first duct.

Furthermore, the end cap may include at least one first adjusting member having a first end interacting with the at least one first duct and a second end controllable from the outside by a user to adjust the passage section of the working fluid passing therethrough.

Furthermore, one of the fixed element and the movable element comprises a hinge body that includes the one working chamber. The elongated tubular wall may be monolithically coupled with the at least one end cap so as the coupling of the latter with the hinge body defines the hydraulic circuit.

In this way, the hydraulic circuit consists exclusively of the interspace between the working chamber and the elongated tubular wall and the at least one first duct passing through the at least one end cap.

Consequently, the hinge body is free of channels or ducts, which implies that it may be manufactured in a simple and cheap way, for example by extrusion.

In fact, the hydraulic circuit is entirely defined by the end cap. When it is not coupled with the cap, the hinge body is free of the hydraulic circuit.

For the aforementioned, the hinge device, while ensuring the checked movement of the door to which it is coupled, is extremely low-bulkiness and it has a minimum number of constituent parts.

Advantageous embodiments of the invention are defined in accordance with the dependent claims.

BRIEF DESCRIPTION OF THE DRAWINGS

Further features and advantages of the invention will appear more evident upon reading the detailed description of some preferred but not exclusive embodiments of a hinge device 1, that are shown as a non-limiting example with the help of the annexed drawings, wherein.

DETAILED DESCRIPTION OF SOME PREFERRED EMBODIMENTS

With reference to the above mentioned figures, the hinge device 1 is particularly useful for rotatably moving and/or checking of a closing element D, such as a door, a shutter, a gate or the like, that may be anchored to a stationary support structure S, such as a wall and/or a frame of a door or of a window and/or a support column and/or the floor.

The hinge device 1 is of hydraulic type. Depending on the configuration, and in particular on the presence or absence of the elastic counteracting means 40, the hinge device 1 may exclusively allow the checking upon the opening and/or closing of the closing element D to which it is coupled, or the latter action and the automatically closing of the closing element D thereof from the open position.

In the latter case, the elastic means 40 may include a thrust spring of relatively high power. However, the elastic means 40, although present, may include a counteracting spring of relatively low power, the power thereof not allowing the automatic closing action.

In general, the hinge device 1 may include a fixed element 10 anchorable to the stationary support structure S and a movable element 11 that may be anchorable to the closing element D.

Preferably, the hinge device 1 may be configured according to the teachings of one or more of the patent applications PCT/IB2012/051707, PCT/IB2013/059120, PCT/IB2013/059121 and VI2013A000245, all in the name of applicant thereof.

Figures 1A, 1B, 1C:
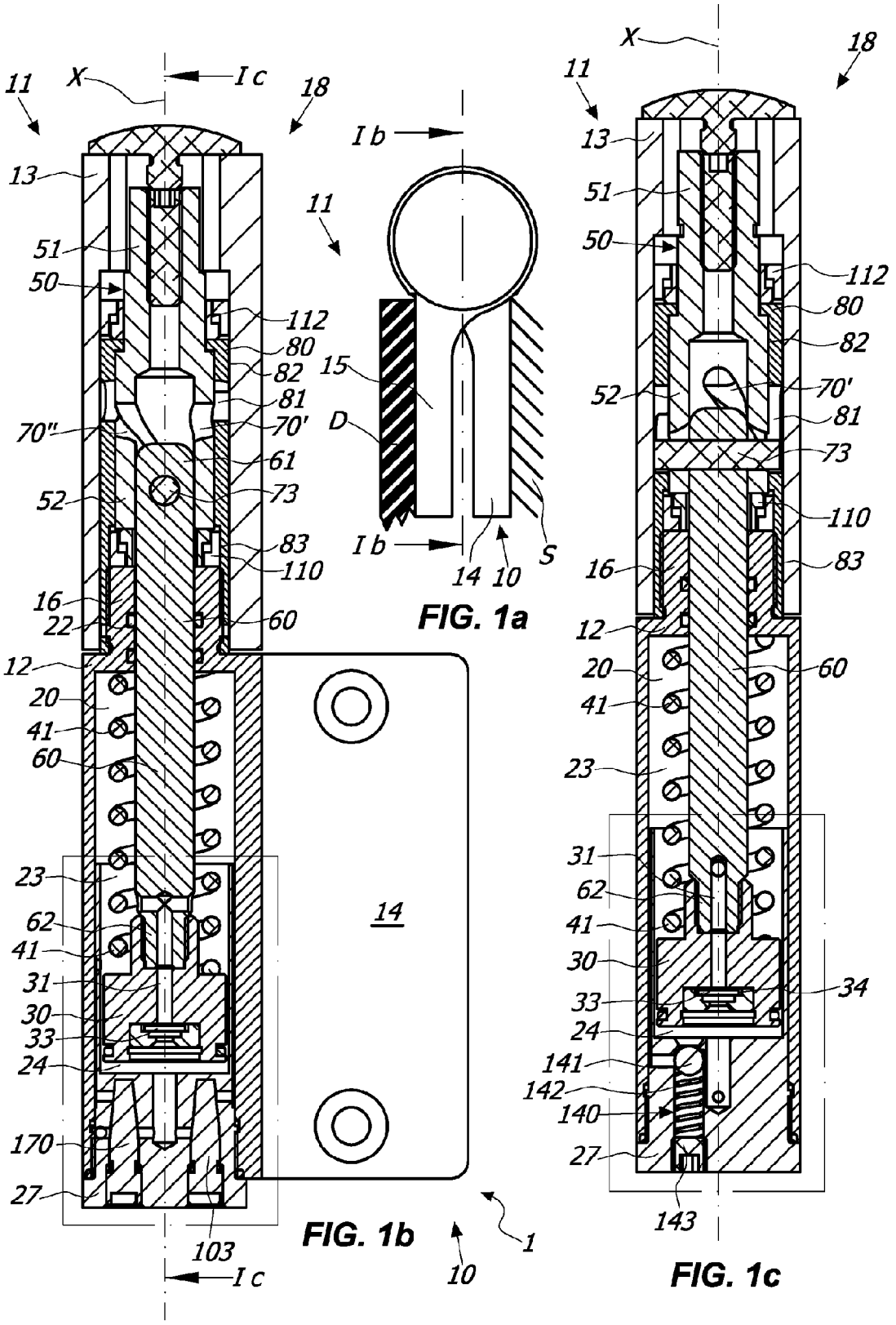
FIG. 1*a* is a top view of a first embodiment of the hinge device 1 in the completely closed position, with in FIG. 1*b* and FIG. 1*c* section views taken along respective planes Ib-Ib and Ic-Ic.
Figure 2B:
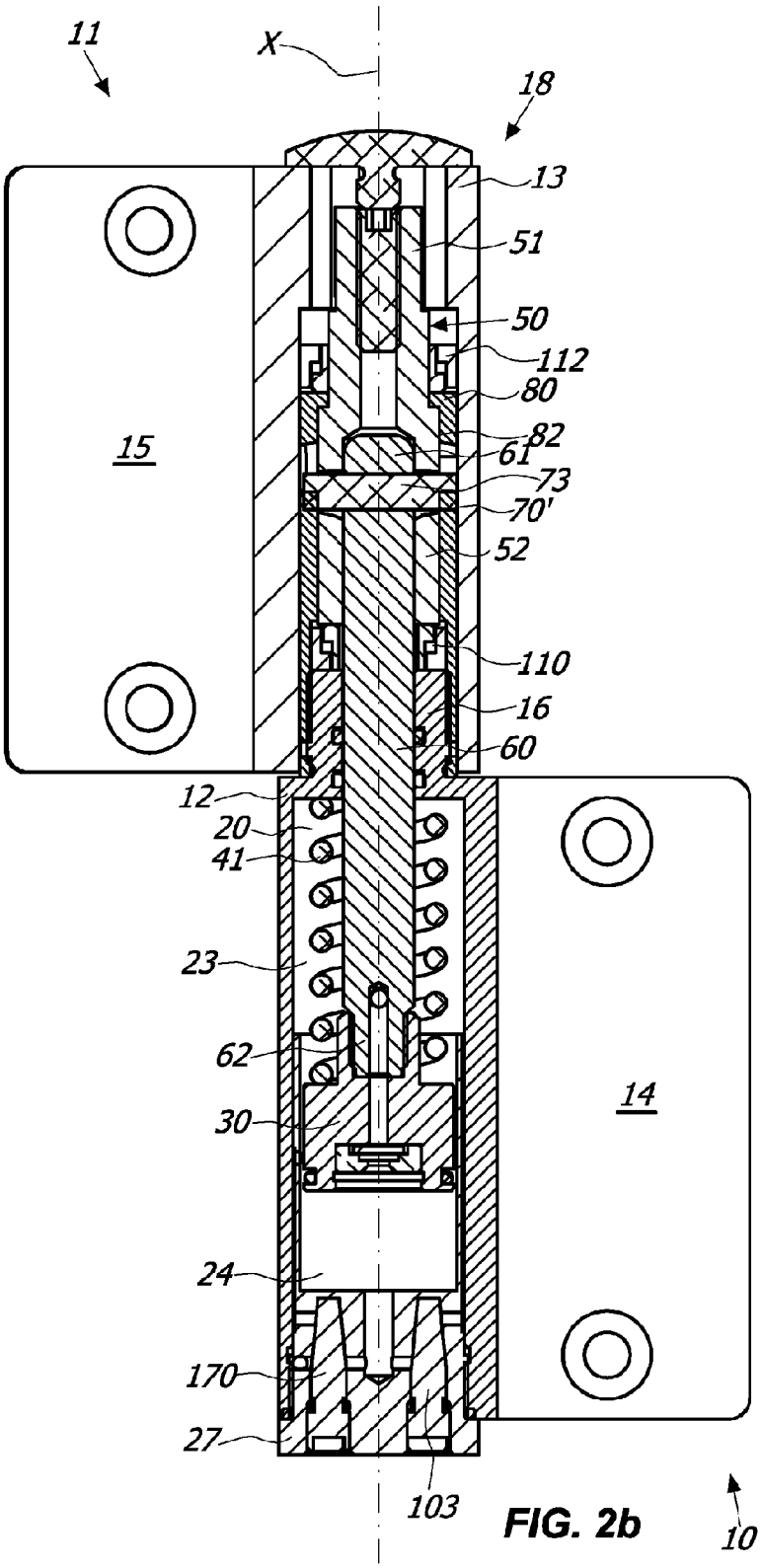
FIG. 2*a* is a top view of the embodiment of the hinge device 1 of FIG. 1*a* in the completely open position, with in FIG. 2*b* a section view taken along a plane IIb-IIb.
Figure 2A:
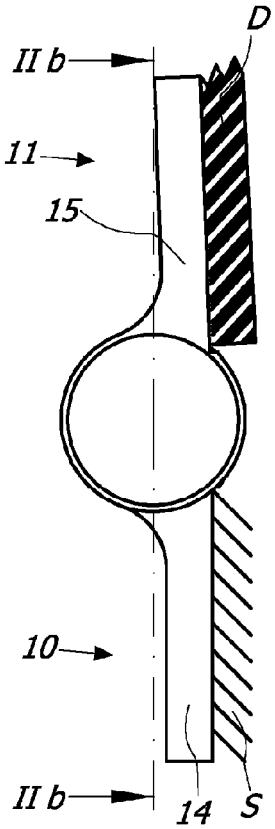
Figure 3B:
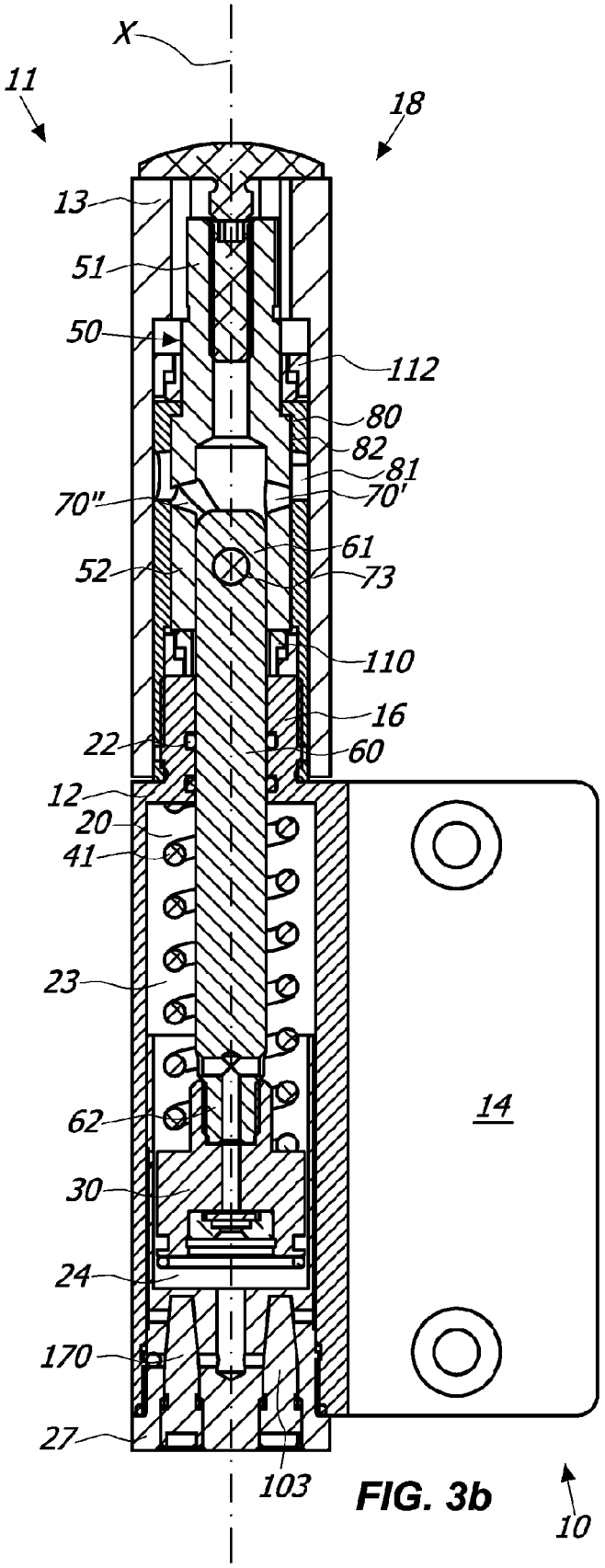
FIG. 3*a* is a top view of the embodiment of the hinge device 1 of FIG. 1*a* in a position near to the closed one, with in FIG. 3*b* a section view taken along a plane IIIb-IIIb.
Figure 3A:
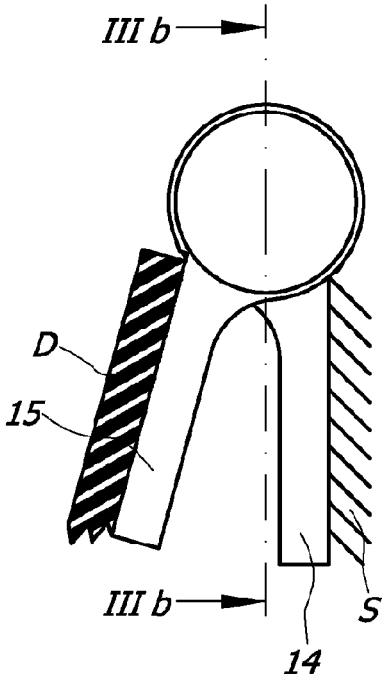
Figure 4:
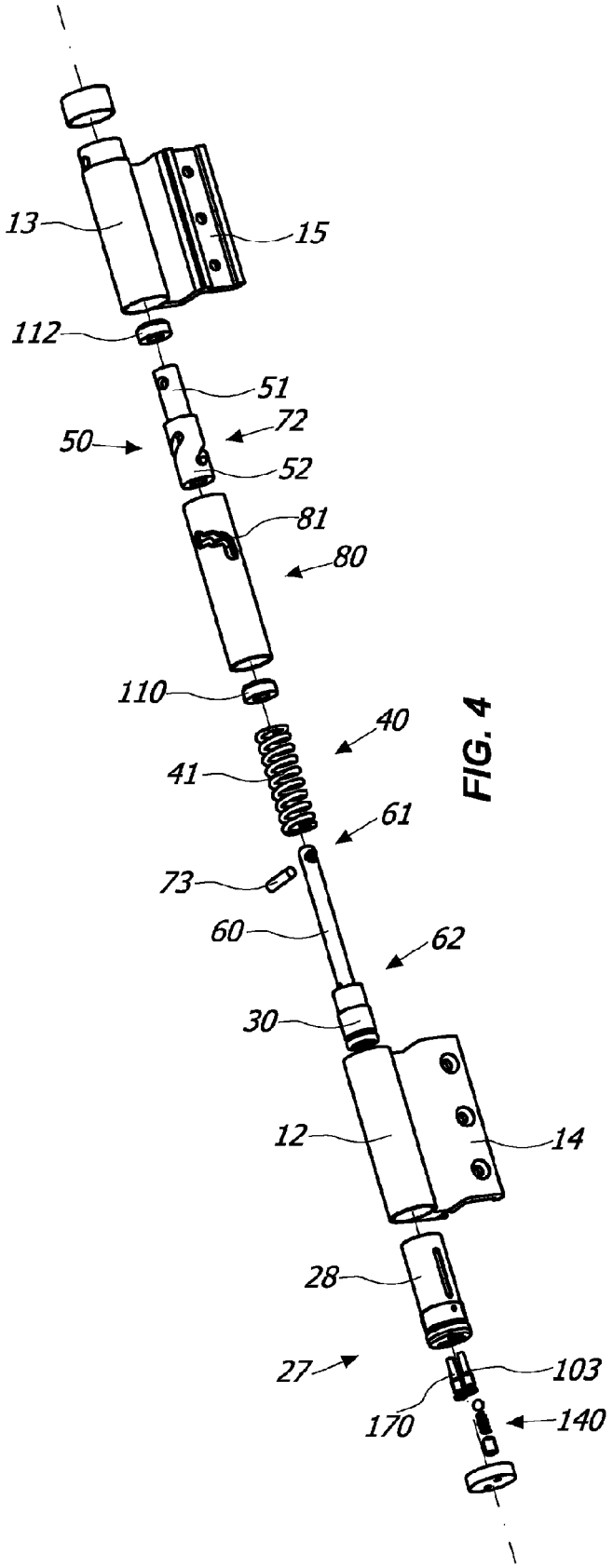
FIG. 4 is an exploded axonometric view of a further embodiment of the hinge device 1.
Figure 5B:
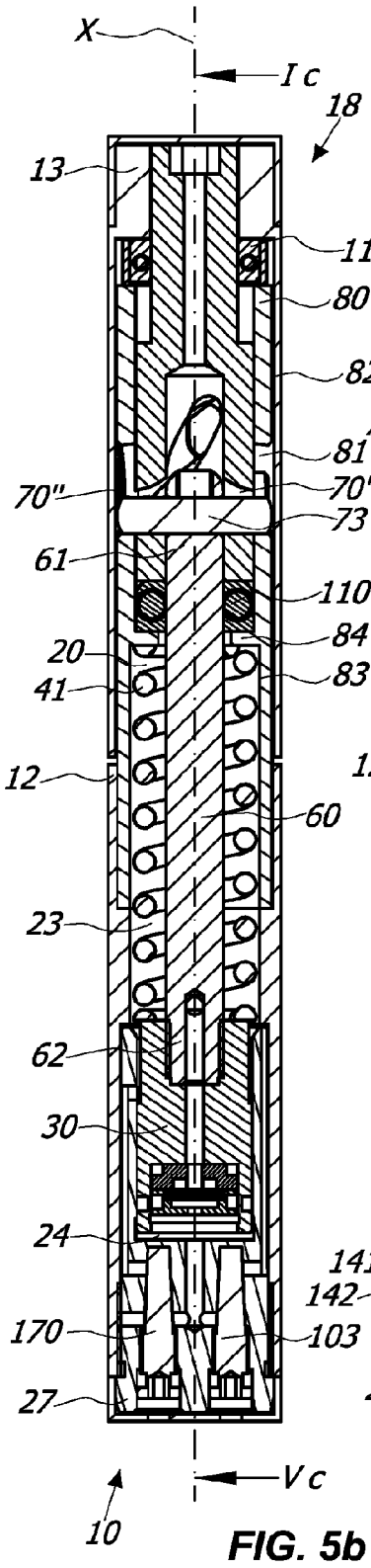
FIG. 5*a* is a top view of the embodiment of the hinge device 1 of FIG. 4 in the completely closed position, with in FIG. 5*b* and FIG. 5*c* section views taken along respective planes Vb-Vb and Vc-Vc.
Figure 5C:
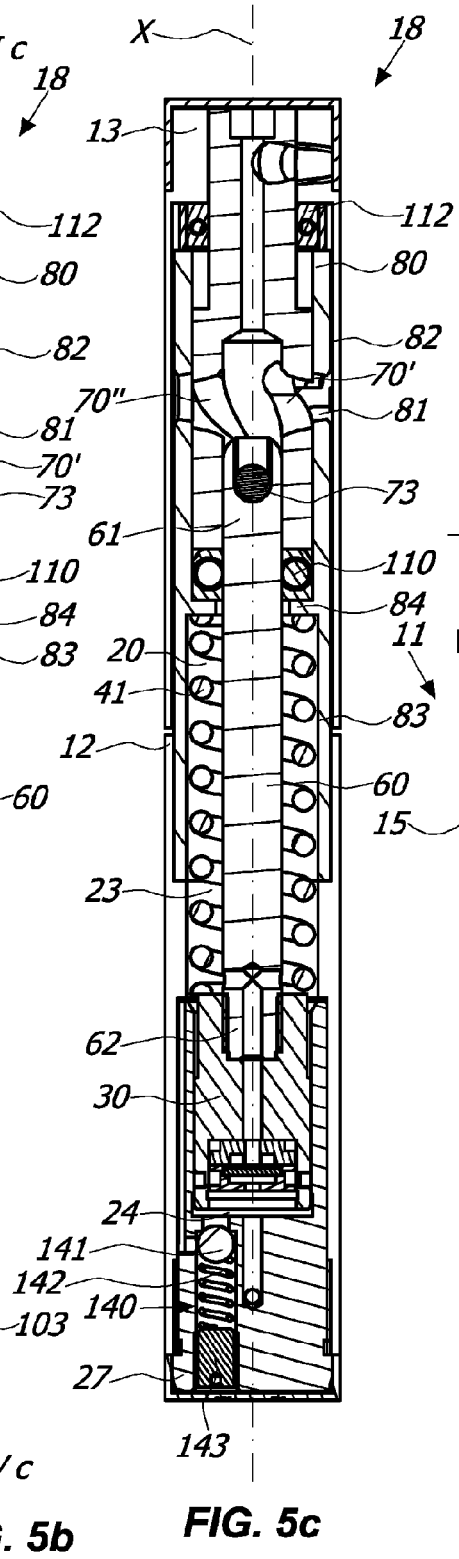
Figure 5A:
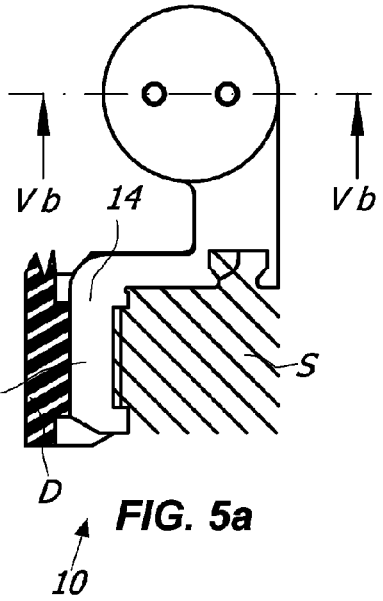
Figure 6B:
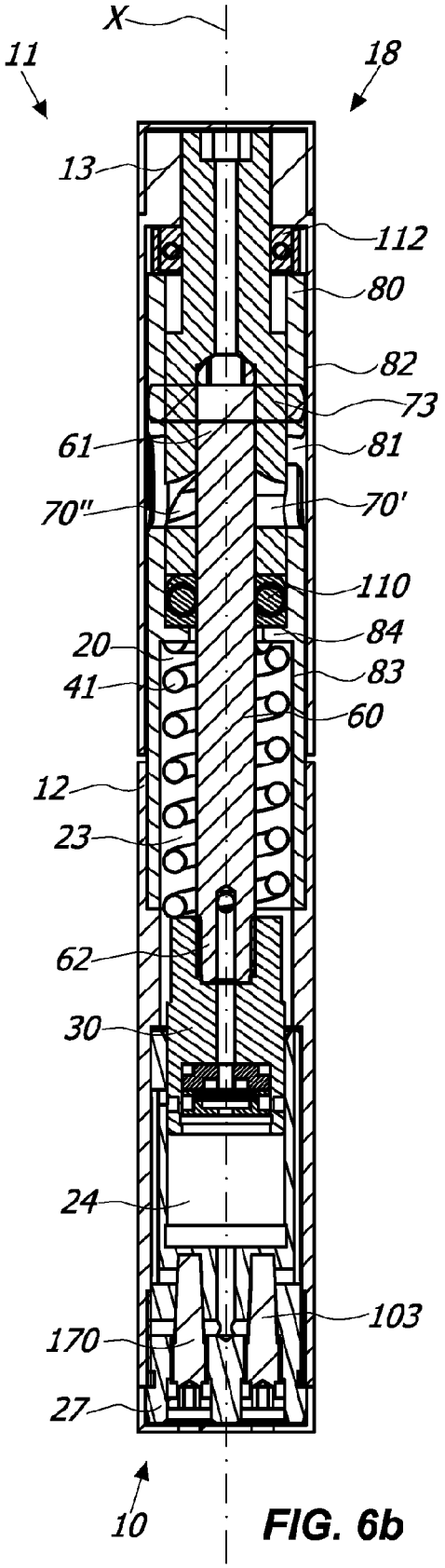
FIG. 6*a* is a top view of the embodiment of the hinge device 1 of FIG. 4 in the completely open position, with in FIG. 6*b* a section view taken along a plane VIb-VIb.
Figure 6A:
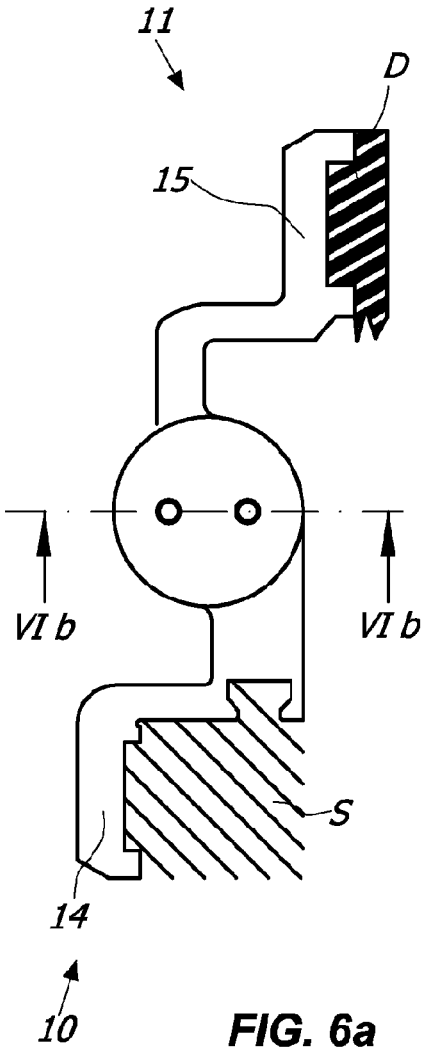
Figure 7B:
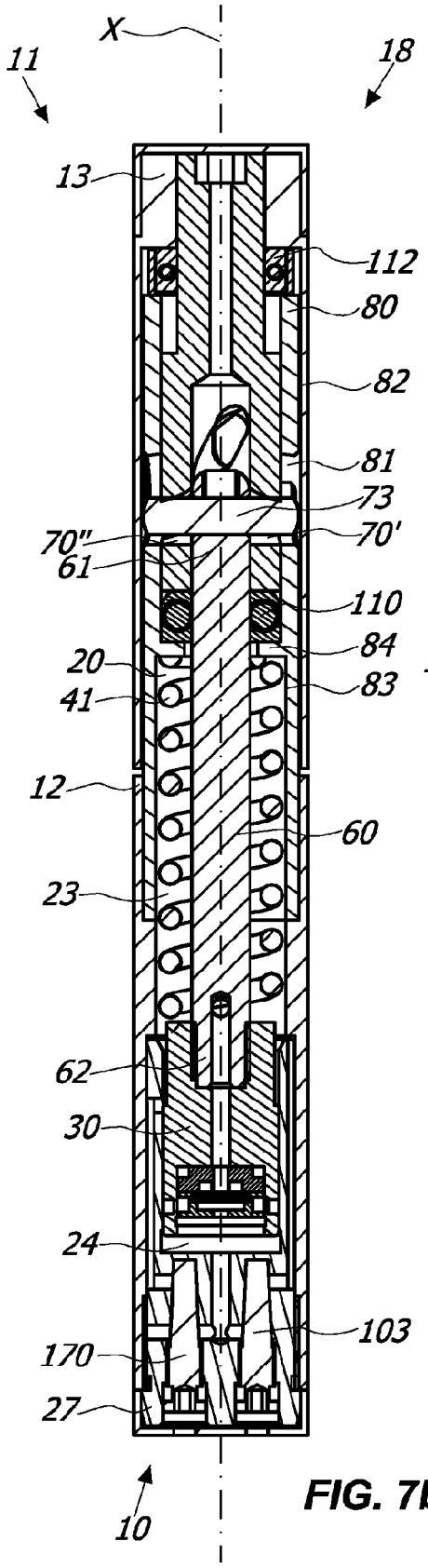
FIG. 7*a* is a top view of the embodiment of the hinge device 1 of FIG. 4 in a position near to the closed one, with in FIG. 7*b* a section view taken along a plane VIIb-VIIb.
Figure 7A:
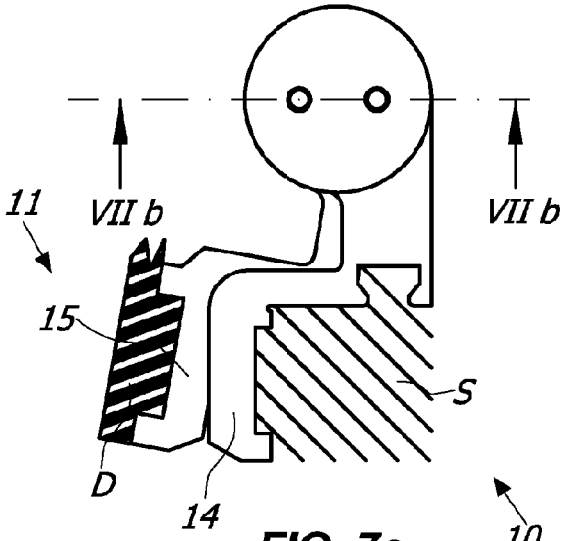
Figure 9:
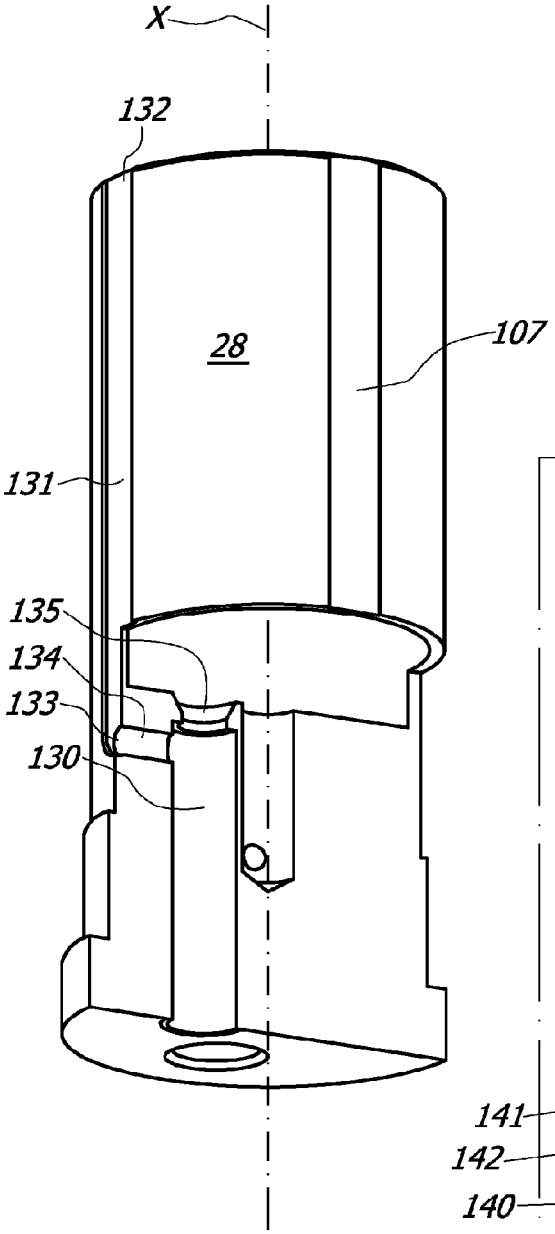
FIG. 9 is an axonometric view of an embodiment of an end cap 27 that is cross sectioned to highlight the second overpressure valve means 140.
Figure 8:
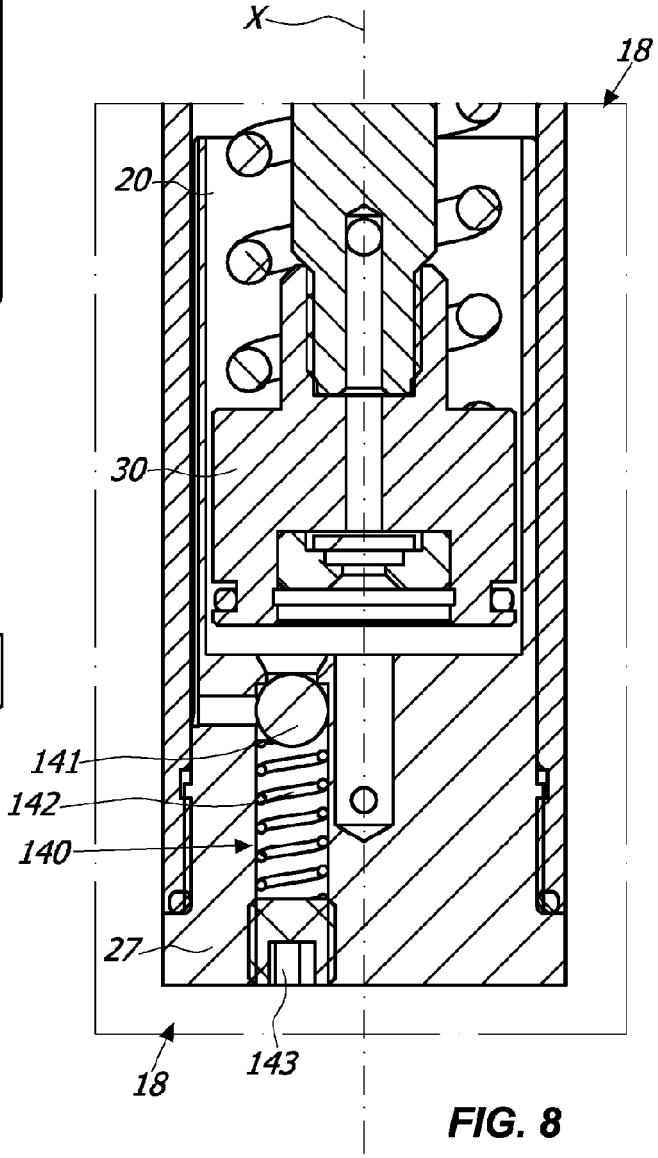
FIG. 8 is an enlarged view of the details enclosed in the closed dotted line of FIG. 1*c;*
Figures 10, 11A, 11B:
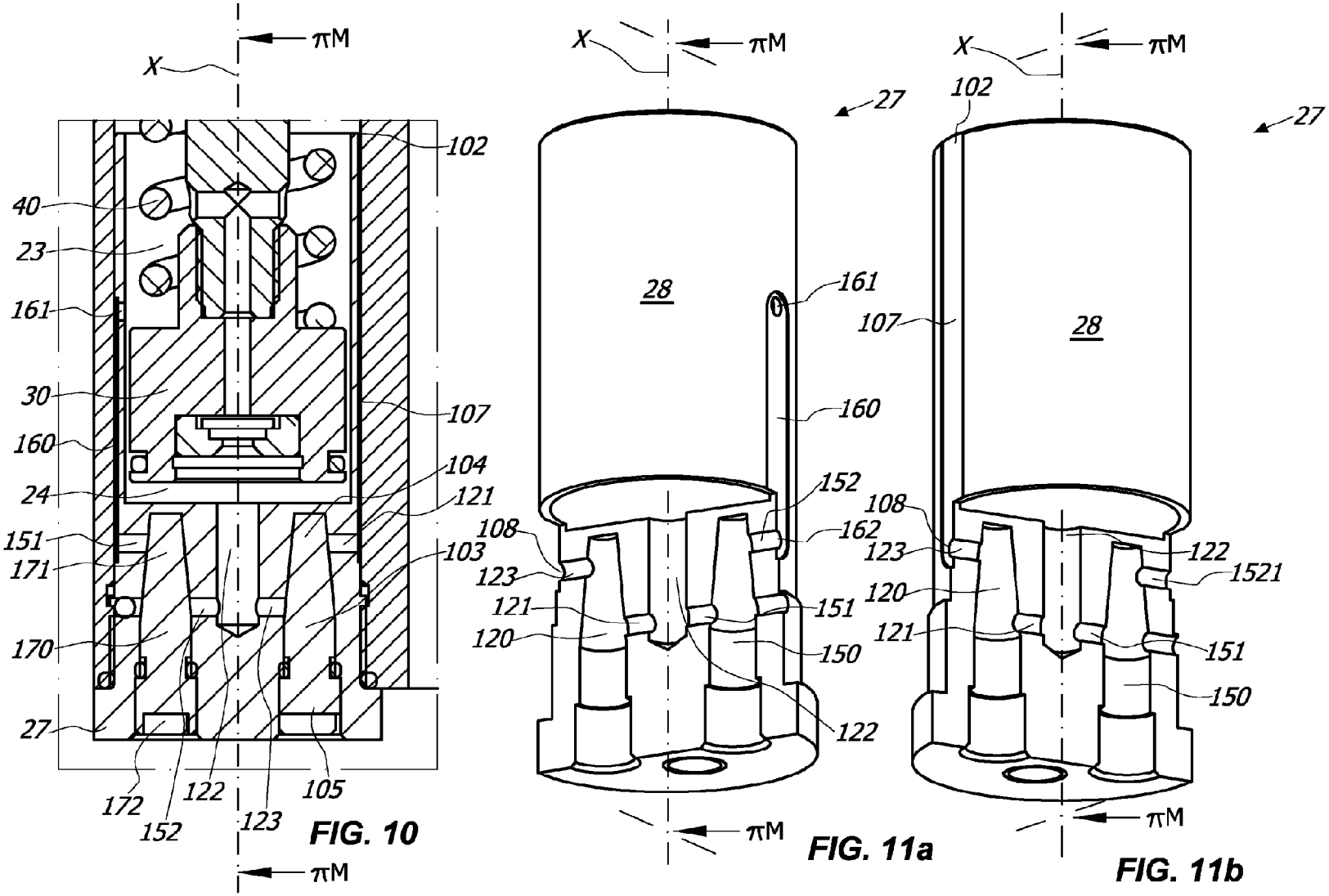
FIG. 10 is an enlarged view of the details enclosed in the closed dotted line of FIG. 1*b;*
FIGS. 11*a* and 11*b* are axonometric views of the embodiment of the end cap 27 of FIG. 9 that are cross sectioned to highlight the ducts 120 and 150 passing therethrough.

In particular, in a preferred but not exclusive embodiment, the fixed 10 and movable 11 elements of the hinge device 1 may include a hinge body 18 with a respective first and second tubular half-shell 12, 13 reciprocally coupled to rotate around a longitudinal axis X between an open position, shown for example in FIGS. 2*a* and 6*a*, and a closed position, shown for example in FIGS. 1*a* and 5*a*.

Suitably, the fixed 10 and movable 11 elements may include a respective first and second fastening wing 14, 15 respectively connected to the first and second tubular half-shell 12, 13 for the anchorage to the stationary support structure S and to the closing element D.

Preferably, the hinge device 1 may be configured as a hinge of "anuba" type.

Advantageously, with the exception of the fastening wings 14, 15, all other components of the hinge device 1 may be included within the first and second tubular half-shell 12, 13.

In particular, the first fixed tubular half-shell 12 may include a working chamber 20 defining the axis X and a plunger member 30 sliding therein. Suitably, the working chamber 20 may be closed at the bottom with an end cap 27 inserted in the tubular half-shell 12.

Moreover, the first fixed tubular half-shell 12 may include a working fluid, generally oil, acting upon the plunger member 30 to hydraulically counteract the action thereof. Preferably, moreover, the first fixed tubular half-shell 12 may comprise elastic counteracting means 40, for example a compressing helical spring 41, acting upon the plunger member thereof 30.

Suitably, externally to the working chamber 20 and coaxially therewith a pivot 50 may be provided, that may advantageously act as an actuator, the pivot 50 may include an end portion 51 and a tubular body 52.

In the preferred but not exclusive embodiment shown in FIGS. 1*a* to 3*b*, the pivot 50 may be supported by the end portion 16 of the first fixed tubular half-shell 12. On the other hand, in the preferred but not exclusive embodiment shown in FIGS. 4 to 11*b*, the pivot 50 may be supported by a support portion 84 manufactured in correspondence of the inner wall 83 of a bushing 80, as explained hereinafter.

The end portion 51 of the pivot 50 allows the coaxial coupling, preferably of removable type, between the pivot 50 thereof and the second movable tubular half-shell 13, so as the latter and the pivot 50 integrally rotate between the open and closed positions of the second movable tubular half-shell 13.

Suitably, the plunger member 30 and the pivot 50 may be operatively connected therebetween through the cylindrical elongated element 60, so as the rotation of the former around the axis X corresponds to the sliding of the latter along the axis X thereof and vice versa.

To the object, the cylindrical elongated element 60 may include a first end portion 61 reciprocally connected to the plunger member 30 and a second end portion 62 sliding within the tubular body 52 of the pivot 50.

The connection between the cylindrical elongated element 60 and the plunger member 30 may be susceptible to make the elements thereof integral, so as the same elements may define a slider movable along the axis X.

Therefore, the cylindrical elongated element 60 may be slidable along the axis X integrally with the plunger member 30. Suitably, the cylindrical elongated element 60 and the pivot 50 may be coupled in a telescopic manner.

Furthermore, the cylindrical elongated element 60 with the relative plunger member 30 may or may not be rotatably blocked in the working chamber 20 to avoid rotations around the axis X during its sliding along the latter. This happens depending on the configuration of the guide cam slots 81 of the bushing 80.

Therefore, with respect to the pivot 50, the plunger member 30 may slide along the axis X between an end-stroke position proximal thereto, corresponding to a one of the open and closed positions of the second movable tubular half-shell 13, and an end-stroke position distal from the pivot 50, corresponding to the other of the open and closed positions of the second movable tubular half-shell 13.

To allow the reciprocal movement between the plunger member 30 and the pivot 50, the tubular body 52 of the latter may include at least one pair of grooves 70', 70" identical to each other angularly spaced by 180°, each one comprising at least one helical portion wound around the axis X. The grooves 70', 70" may be communicating with each other to define a single passing-through actuator element 72.

Suitably, the at least one helical portion may have any angle, and may have right-handed trend, respectively left-handed trend. Preferably, the at least one helical portion may develop for at least 90° around the axis X, and even more preferably for at least 180°.

In a preferred but not exclusive embodiment, each one of the grooves 70', 70" may consists of a single helical portion, possibly with constant inclination or helical pitch. Suitably, the actuator element 72 may be closed at both ends so as to define a closed path having two blocking end points for the pin 73 sliding therethrough, the closed path being defined by the grooves 70', 70".

Irrespective of its position or configuration, the passing-through actuator element 72 rotating around the axis X allows the reciprocal movement between the pivot 50 and the plunger member 30.

To guide such a rotation, a tubular guide bushing 80 may be provided coaxially placed outside the tubular body 52 of the pivot 50. The guide bushing 80 may include a pair of cam slots 81 angularly spaced by 180°.

To allow the reciprocal connection between the pivot 50, the elongated element 60 and the guide bushing 80, the second end portion 62 of the elongated element 60 may include a pin 73 inserted in the passing-through actuator element 72 and in the cam slots 81 to slide therein.

Therefore, the length of the pin 73 may be such as to allow this function. Therefore, upon the rotation of the passing-through actuator element 72, the pin 73 is driven by the latter and guided by the cam slots 81.

Irrespective of the shape of the cam slots 81, the latter may be closed at both ends so as to define a closed path having two blocking end points for the pin 73 sliding therethrough.

In order to minimize the friction between the moving parts, at least one anti-friction element may be provided, such as an annular bearing 110, interposed between the pivot 50 and the end portion 16 of the first tubular half-shell 12 or between the pivot 50 thereof and the support portion 84 of the bushing 80.

In fact, as above mentioned, thanks to the above configuration the pin 73 is pulled downwards, dragging therewith the pivot 50 that, therefore, rotates around the axis X on the bearing 110 with the minimum friction.

Furthermore, at least one further anti-friction element may be provided, for example a further annular bearing 112, interposed between the bushing 80 and the second tubular half-shell 13, in such a way that the latter rotates around the axis X on the bearing 112.

Therefore, the bearing 112 rests on the upper portion of the bushing 80, so as the pivot 50 is not affected by the weight of the closing element during its rotation around the axis X.

Preferably, moreover, the bushing 80 and the second tubular half-shell 13 may be in a reciprocal spatial relationship such that the second tubular half-shell 13 once coupled with the bushing 80 remains spaced from the first tubular half-shell 12, for example at a distance equal to few tenths of a millimeter.

As above mentioned, the hinge device 1 may include a working fluid, for example oil.

Advantageously, one or more sealing elements 22 may be provided to avoid the discharge thereof, for example one or more o-rings.

The plunger member 30 may be susceptible to divide the working chamber 20 in at least one first and one second variable volume compartment 23, 24 fluidly communicating therebetween and preferably adjacent. Suitably, when present, the elastic counteracting means 40 may be inserted in the first compartment 23.

In a first preferred but not exclusive embodiment, the elastic counteracting means 40 may be interposed between the pivot 50 and the plunger member 30. For example, the elastic counteracting means 40 may include a spring fitted over the elongated element 60.

To allow the passage of the working fluid between the first and the second compartment 23, 24, the plunger member 30 may comprise a passing-through opening 31 and valve means, that may include a disk 33 inserted with minimal play in a suitable house 34 to axially move along axis X. The assembly disk 33—house 34 defines a non-return valve susceptible to intercept the working fluid.

Depending on the direction to which the non-return valve is assembled, it may open upon the opening or closing of the closing element D, so as to allow the passage of the working fluid between the first compartment 23 and the second compartment 24 during one of the opening or closing of the closing element D and to prevent the backflow thereof during the other of the opening or closing thereof.

For the controlled backflow of the working fluid between the first compartment 23 and the second compartment 24 during the other of the opening or closing of the closing element D, a suitable hydraulic circuit 100 may be provided.

Suitably, the plunger member 30 may include, respectively consist of, a cylindrical body tightly inserted in the working chamber 20 and faced to the inner side wall 25 thereof.

In general, the hydraulic circuit 100 may include a channel 107 with an opening 102 in the first compartment 23.

Furthermore, the hydraulic circuit 100 may include a duct 120 passing through the end cap 27 that includes an opening 121 fluidly communicating with the opening 102 and an opening 122 fluidly communicating with the second compartment 24.

Moreover, the hydraulic circuit 100 may further include a duct 150 passing through the end cap 27 that, as better explained hereinafter, is fluidly connected with the duct 120.

Furthermore, the hydraulic circuit 100 may include a duct 130 passing through the end cap 27 thereof to put in fluid communication the first compartment 23 and the second compartment 24.

Suitably, the end cap 27 may further include valve means 140 acting upon the duct 130 to selectively open upon the passage of the working fluid through the channel 107 when the pressure PC in the working chamber 20 exceeds a predetermined threshold value PT.

To protect the entirety of the closing element D that assembles the hinge device 1, the threshold pressure value PT may be calibrated in order to avoid the unhinging of the closing element D thereof by a user that forces the opening and/or closing.

From the constructive point of view, the valve means 140 may include a shutter element 141 acting upon the duct 130, and more precisely upon the outlet 135 thereof, and elastic means 142 acting thereon. Both the shutter element 141 and the elastic means 142 may be inserted in the duct 130 and closed by the grub screw 143.

Advantageously, the elastic means 142 may be selected to provide the threshold pressure value PT.

On the other hand, the screw 143 may be one adjusting screw movable from outside by a user to act upon the second elastic means 142, so as to vary the action thereof on said shutter element 141 thus adjusting the predetermined threshold pressure value PT.

From an operational point of view, the valve means 140 may be closed when the pressure PC in the working chamber 20 is below the threshold value PT to prevent the passage of the working fluid through the duct 130, so as to force the passage thereof through the duct 120.

Advantageously, the threshold pressure value PT may be greater than the maximum pressure PCmax imparted in the working chamber 20 by the elastic counteracting means 40. Preferably, the threshold pressure value PT is greater than the maximum pressure PCmax of a percentage of 15% to 30%.

In a preferred but not exclusive embodiment, the end cap 27 may include an elongated tubular wall 28 extending within the working chamber 20. In such a case, the hydraulic circuit 100 may include the interspace between the working chamber 20 and the elongated tubular wall 28 of the end cap 27.

Suitably, the elongated tubular wall 28 may be tightly inserted in the working chamber 20, while the plunger member 30 may be tightly inserted in the elongated tubular wall 28. Preferably, the length of the latter may be equal to or greater than the stroke of the plunger member, so as the second compartment 24 is defined within the elongated tubular wall 28. More particularly, the second compartment 24 may have an upper wall defined by the plunger member 30, a bottom wall defined by the cap 27 and a side wall defined by the elongated tubular wall 28 of the cap 27 thereof.

Preferably, the elongated tubular wall 28 may be monolithically coupled with the end cap 27 so as the screwing of the latter in the hinge body 18 defines the hydraulic circuit 100, so as the latter consists exclusively of the interspace between the working chamber 20 and the elongated tubular wall 28 and of the ducts 120, 130 and 150.

The elongated tubular wall 28 of the end cap 27 may include a peripheral conduit defining the channel 107, a peripheral conduit defining a further channel 131 and a further conduit 160.

Suitably, both conduits 107 and 131 are open conduits, while the conduit 160 is a blind conduit.

The conduit 107 may have a port defining the opening 102 and a port 108 in fluid communication with the opening 121, and, therefore, with the variable volume compartment 24 through the duct 120. More particularly, the latter may include two branches 121 and 123, whereof the first 121 in fluid communication with the port 108 and the second 123 in fluid communication with the compartment 24 through the collector 122, whose function is better explained hereinafter.

The conduit 131 may have a port 132 in the first variable volume compartment 23 and a port 133 in fluid communication with the variable volume compartment 24 through the duct 130. The latter may have a branch 134 and an opening 135, wherebetween the valve means 140 may be placed.

The conduit 160 may have a port 161 and a port 162 in fluid communication with the variable volume compartment 24 through the duct 150. More particularly, the latter may include two branches 151 and 152, whereof the first 151 in fluid communication with the port 162 and the second 152 in fluid communication with the compartment 24 through the collector 122.

As above mentioned, the duct 130 in cooperation with the valve means 140 defines a overpressure valve.

On the other hand, in the ducts 120 and 150 respective adjusting members 103, 170 may be inserted having one end 104, 171 interacting with the ducts 120 and 150 thereof and one end 105, 172 controlled from outside by a user to adjust the passage section of the working fluid passing therethrough.

Advantageously, the ends 104, 171 have a substantially frustoconical shape.

Since the plunger member 30, the elongated tubular wall 28 and the working chamber 20 are tightly inserted one inside the other, the assemblies conduit 107—duct 120, conduit 130—duct 131 and conduit 160—duct 150 define respective hydraulic circuits independent between them.

Although in the annexed figures the two adjusting members are substantially parallel to the axis X, they may also be substantially perpendicular thereto without departing from the scope of the appended claims.

In case the valve means 32 are configured to open upon the passage of the working fluid from the first compartment 23 to the second compartment 24 and to close upon the opposite passage so as to force the working fluid to pass through the hydraulic circuit 100, the branches 121 and 151 define inlet branches of the working fluid in the ducts 120 and 150, while the branches 123 and 152 define outlet branches therefrom. It is obvious that the working fluid passing through the outlet branches 123 and 152 comes out through the ports 108 and 162, goes back up through the conduits 107 and 160 and flows out in the variable volume compartment 23 through the ports 102 and 161.

When the working chamber 20 is pressurized, for example during the opening of the door, the valve means 32 open to let the working fluid flow from the first compartment 23 to the second compartment 24. On the other hand, during the closing of the door the valve means 23 close, forcing the working fluid from the compartment 24 to the central collector 122, and here-hence to the inlet branches 121 and 151 mentioned above.

Therefore, the central collector 122 collects the working fluid coming from the compartment 24 and distributes it to the two branches 121 and 151. Advantageously, therefore, the central collector 122 may be placed along the axis X, while the adjusting members 103 and 170 may be placed on opposite sides with respect to a median plane $\pi M$ passing through the axis X.

Moreover, the duct 130 may be misaligned with respect to the two ducts 120, 150.

This allows to have the two adjusting members 103, 170 and the overpressure valve means 140 in a extremely reduced space.

Suitably, the inlet branches 121 and 151 may be faced to a portion of the ends 104, 171 of the adjusting members 103, 170 having a section greater than the one to which the outlet branches 123 and 152 are faced, so as to minimize or eliminate variations of flow of the working fluid through the respective ducts 120 and 150.

In a preferred but not exclusive embodiment, the plunger member 30, the conduit 107 and the conduit 160 may be reciprocally configured so as the port 102 remains fluidly free throughout the stroke of the plunger member 30 and so as the port 161 remains fluidly blocked for a part of the stroke of the plunger member 30 and fluidly free for a second part of the stroke thereof near the open or closed position of the closing element D, so as the latter snap fits towards the open or closed position thereof.

Therefore, the adjusting member 103 may be susceptible to adjust the speed upon the closing or opening of the closing element D, while the adjusting member 170 may be susceptible to adjust the force of the snap-fit of the closing element D towards the closed or open position.

For the aforementioned, the end cap 27 allows to provide an extremely safe hinge device thanks to the overpressure valve means 140 and easily adjustable both in speed and in snap-fit thanks to the adjusting members 103, 170, all in a very reduced space.

From the above description, it is evident that the invention fulfils the intended objects.

The invention is susceptible of numerous modifications and variations, all falling within the inventive concept expressed in the accompanying claims. All particulars may be replaced with other technically equivalent elements, and the materials may be different according to requirements, without departing from the scope of the invention defined by the appended claims.

The invention claimed is:

1. A hinge device for rotatably moving or checking during opening or closing of a closing element, anchored to a stationary support structure, comprising:

a fixed element anchorable to the stationary support structure;

a movable element anchorable to the closing element, said movable element and said fixed element being reciprocally coupled to rotate around a first longitudinal axis between an open position and a closed position; and a slider movable along a second longitudinal axis between a first end-stroke position, corresponding to one of said open and closed positions, and a second end-stroke position, corresponding to the other one of said open and closed positions, wherein one of said fixed element or said movable element comprises a working chamber defining said second longitudinal axis to slidably house said slider, the other one of said fixed element or said movable element comprising a pivot defining said first axis, said pivot and said slider being reciprocally coupled so that a rotation of the movable element around said first axis corresponds to at least a partial sliding of the slider along said second axis and vice versa, said working chamber including at least one end cap, wherein said working chamber includes a working fluid acting upon said slider to hydraulically counteract an action thereof, said slider including a plunger member dividing said working chamber in at least one first and one second variable volume compartments fluidly communicating with each other, said plunger member comprising a first valve allowing passage of the working fluid between said first compartment and said second compartment during one of the opening or closing of the closing element and preventing the passage thereof during the other one of the opening or closing of the closing element, a hydraulic circuit being further provided that allows passage of the working fluid between said first compartment and said second compartment during the other one of the opening or closing of the closing element, wherein said hydraulic circuit includes a first duct passing through said end cap in fluid communication with both said first compartment and said second compartment, said end cap further including a first adjusting member having a first end interacting with said first duct and a second end controllable from outside by a user to adjust a passage section of the working fluid passing therethrough, and wherein said hydraulic circuit includes a second duct passing through said end cap in fluid communication with both said first compartment and said second compartment, said end cap further including a second adjusting member having a third end interacting with said second duct and a fourth end controllable from the outside by the user to adjust the passage section of the working fluid passing therethrough.

2. The device according to claim 1, wherein said end cap includes an elongated tubular wall extending within said working chamber, said hydraulic circuit including an interspace between said working chamber and said elongated tubular wall.

3. The device according to claim 2, wherein said elongated tubular wall is inserted in said working chamber, said plunger member being inserted into said elongated tubular wall, the elongated tubular wall including a first peripheral conduit having a first port in one of said first compartment or said second compartment and a second port in fluid communication with the other one of said first compartment or said second compartment through said first duct.

4. The device according to claim 3, wherein said elongated tubular wall is monolithically coupled with said end cap so that a coupling of said end cap with said working chamber defines said hydraulic circuit, causing said hydraulic circuit to consist of said interspace between said working chamber and said elongated tubular wall and of said first duct passing through said end cap.

5. The device according to claim 3, wherein said first valve is configured to open upon the passage of the working fluid from said first compartment to said second compartment and to close upon the passage of the working fluid from said second compartment to said first compartment, thereby forcing the working fluid to flow through said hydraulic circuit.

6. The device according to claim 5, wherein said first end of said first adjusting member has a substantially frustoconical shape, said first duct including a first inlet branch and a first outlet branch both faced to said first end of said at adjusting member, said first inlet branch being faced to a portion of said first end of said first adjusting member having a section greater than a section to which said first outlet branch is faced so as to minimize or eliminate flow variations of said working fluid.

7. The device according to claim 6, wherein said plunger member and said first peripheral conduit are reciprocally configured so that said first port remains fluidly free for an entire stroke of said plunger member, so that said first adjusting member is susceptible to adjust speed upon the closing or opening of said closing element.

8. The device according to claim 3, wherein said first duct and second duct are in fluid communication with a single central collector placed along said first axis, said first adjusting member and said second adjusting member being placed on opposite sides with respect to a median plane passing through said first axis.

9. The device according to claim 3, wherein said elongated tubular wall includes a second peripheral conduit having a third port in said one of said first compartment or said second compartment, and a fourth port in fluid communication with the other one of said first compartment or said second compartment through said second duct.

10. The device according to claim 9, wherein said plunger member and said second peripheral conduit are reciprocally configured so that said third port remains fluidly blocked for a part of a stroke of said plunger member and fluidly free for a second part of the stroke thereof, said third port being in a spatial relationship with said plunger member to remain fluidly free near the open or closed position of the closing element so that the closing member snap-fits toward the open or closed position, said second adjustment member adjusting a force of a snap-fitting of said closing element toward the closed or open position.

11. The device according to claim 8, wherein said third end of said adjusting member has a substantially frustoconical shape, said second duct including a second inlet branch and a second outlet branch both faced to said third end of said second adjusting member, said second inlet branch being faced to a portion of said third end of said second adjusting member having a section greater than a section to which said second outlet branch is faced to minimize or eliminate flow variations of said working fluid.

12. The device according to claim 11, wherein said first and said second inlet branch, respectively said first and said second outlet branch, are reciprocally faced to merge in said single central collector to put the same branches in fluid communication with one of said first compartment and said second compartment, said first and said second outlet branch, respectively said first and said second inlet branch, being both in fluid communication with said second compartment or said first compartment.

13. The device according to claim 3, wherein said hydraulic circuit further includes a third duct passing through said end cap in fluid communication with both said first compartment and said second compartment, said elongated tubular wall including a third peripheral conduit having a fifth port in one of said first compartment or said second compartment and a sixth port in fluid communication with the other one of said first compartment or said second compartment through said third duct, said end cap further including a second valve acting upon said third duct to selectively open upon the passage of the working fluid through said first peripheral conduit when pressure in said working chamber exceeds a predetermined threshold value, said third duct being misaligned with respect to said first duct and said second duct.

* * * * *